US009809413B2

(12) United States Patent
Reinisch

(10) Patent No.: US 9,809,413 B2
(45) Date of Patent: Nov. 7, 2017

(54) WINDING DEVICE FOR STRAND SHAPED WINDING MATERIAL

(71) Applicant: Maschinenfabrik NIEHOFF GmbH & Co. KG, Schwabach (DE)

(72) Inventor: Hubert Reinisch, Freiberg am Neckar (DE)

(73) Assignee: Maschinenfabrik Niehoff GmbH & Co. KG, Schwabach (DE)

( * ) Notice: Subject to any disclaimer, the term of this patent is extended or adjusted under 35 U.S.C. 154(b) by 124 days.

(21) Appl. No.: 14/742,511

(22) Filed: Jun. 17, 2015

(65) Prior Publication Data

US 2016/0023862 A1 Jan. 28, 2016

Related U.S. Application Data

(63) Continuation of application No. PCT/EP2013/003681, filed on Dec. 5, 2013.

(30) Foreign Application Priority Data

Dec. 18, 2012 (DE) ..... 10 2012 024 759

(51) Int. Cl.
*B65H 54/82* (2006.01)
*B21C 47/14* (2006.01)

(52) U.S. Cl.
CPC ..... *B65H 54/82* (2013.01); *B21C 47/14* (2013.01)

(58) Field of Classification Search
CPC ..... B65H 51/20; B65H 51/22; B65H 54/76; B65H 54/78; B65H 54/80; B65H 54/82;
(Continued)

(56) References Cited

U.S. PATENT DOCUMENTS 3,455,341 A 7/1969 Pfaffwaller et al.
3,759,300 A * 9/1973 Pfarrwaller ..... B65H 51/22 139/452
(Continued)

FOREIGN PATENT DOCUMENTS

CN 1789519 A 6/2006
CN 101195946 A 6/2008
(Continued)

OTHER PUBLICATIONS

International Preliminary Report on Patentability issued in corresponding application PCT/EP2013/003681 dated Jun. 23, 2015.
(Continued)

*Primary Examiner* — William E Dondero
(74) *Attorney, Agent, or Firm* — Knobbe Martens Olson & Bear LLP

(57) ABSTRACT

A winding device for winding a strand like winding material is disclosed. The winding device includes a winding disk onto which the strand like winding material is wound, and a housing being arranged adjacently to the winding disk. The winding disk is prevented from moving, for example, from twisting, by at least one magnetic holding device. The magnetic holding device has a first magnetic arrangement, which is connected torque proof to the housing, and a second magnetic arrangement, which is connected torque proof to the winding disk, each magnetic arrangement having a north pole N and a south pole S. Between the first and second magnetic arrangements there is a gap. The first and second magnetic arrangements are magnetically coupled across the gap, wherein the strand shaped winding material is guided through the gap.

12 Claims, 5 Drawing Sheets

(58) Field of Classification Search
CPC ..... B21C 47/14; B21C 47/143; B21C 47/146; D03D 47/361; D04B 15/482
See application file for complete search history.

(56) References Cited

U.S. PATENT DOCUMENTS

| | | | | |
|---|---|---|---|---|
| 3,971,522 | A | 7/1976 | Pfarrwaller | |
| 4,304,366 | A * | 12/1981 | Enneking | B65H 54/82 242/361.3 |
| 4,339,091 | A | 7/1982 | Enneking et al. | |
| 4,429,723 | A * | 2/1984 | Maroino | D03D 47/366 139/452 |
| 4,444,226 | A | 4/1984 | Ichikawa et al. | |
| 4,478,375 | A | 10/1984 | Sarfati et al. | |
| 4,695,002 | A * | 9/1987 | Raasch | B65H 51/22 242/365.3 |
| 5,934,108 | A | 8/1999 | Berns'Au | |
| 6,308,742 | B1 | 10/2001 | Peulen et al. | |

FOREIGN PATENT DOCUMENTS

| | | | | |
|---|---|---|---|---|
| CN | 102367623 | A | 3/2012 | |
| DE | 2352521 | A1 | 4/1975 | |
| DE | 2408031 | A1 | 8/1975 | |
| DE | 3642177 | A1 | 6/1988 | |
| EP | 2392531 | A2 | 12/2011 | |
| GB | 845225 | | 8/1960 | |
| JP | S43-026564 | Y1 | 11/1968 | |
| JP | S58-036244 | A | 3/1983 | |
| JP | 2011-251820 | | 12/2011 | |
| NL | EP 0525906 | A1 * | 2/1993 | B65H 51/22 |
| SU | 366143 | A | 4/1973 | |

OTHER PUBLICATIONS

International Search Report issued in corresponding application PCT/EP2013/003681 dated Feb. 28, 2014.

Written Opinion of the International Searching Authority issued in corresponding application PCT/EP2013/003681 dated Feb. 28, 2014.

Chinese Search Report and Office Action dated Oct. 9, 2016 for corresponding Application No. 201380064292.9; 13 pages.

Japanese Office Action dated Feb. 13, 2017 for corresponding Application No. 2015548269.

The Decision on Grant issued in related Russian patent application 2015129101 dated Mar. 29, 2017.

* cited by examiner

WINDING DEVICE FOR STRAND SHAPED WINDING MATERIAL

CROSS-REFERENCE TO RELATED APPLICATIONS

This application is a continuation application, and claims the benefit under 35 U.S.C. §§120 and 365 of PCT Application No. PCT/EP2013/003681, filed on Dec. 5, 2013, which is hereby incorporated by reference. PCT/EP2013/003681 also claimed priority from German Patent Application No. 10 2012 024 759.1 filed on Dec. 18, 2012, which is hereby incorporated by reference.

BACKGROUND

Field

The described technology generally relates to a winding device for winding a strand shaped winding material.

Description of the Related Technology

The strand shaped winding material can be, for example, a metallic or a non-metallic, a coated or a non-coated wire, a single-core or a multi-core cable, a fiber, such as a natural fiber or a synthetic fiber, particularly a fiber for special technical applications such as an optical fiber, a thread, a string or a rope.

The winding device includes a winding disk with a generally circular cross section, wherein on its outer peripheral surface the strand shaped winding material is wound. The winding disk has generally the shape of a flat cylinder, whose height is dimensioned so that several windings of the strand shaped winding material may be wound on the outer peripheral surface simultaneously. The winding disk can be arranged horizontally in the winding device, but it can also be arranged vertically or in another orientation.

The winding disk is fixed during the operation of the winding device. The winding of the strand shaped winding material on the winding disk is carried out by a suitable rotary winding mechanism for the winding material, for example, by one or more deflection rollers with a continuous rotary motion around outside the peripheral surface of the winding disk and in the form of a rotary winding on this circumferential surface. The settling of the strand shaped winding material can be done near an axial end of the winding disk. The windings, which are formed on the peripheral surface of the winding disk, are then pushing each other in the axial direction of the winding disk until they reach the other axial end of the winding disk.

However, after the winding of the strand shaped winding material on the winding disk, it is not to remain on the winding disk (in terms of a winding bobbin for the storage and transport of the winding material), but it is further processed in various ways after the winding on the winding disk:

On the one hand, the windings of the strand shaped winding material on the other axial end of the winding disk can slip off again without any further support or guidance from the winding disk and fall into a container, such as a barrel, which is used for storing and for transporting the strand shaped winding material. In this case, the winding disk can be arranged horizontally and the container is under the winding disk. A winding device of this kind is also referred to as drum winder. It can be used for strand shaped like winding material which is plastically deformed to a certain extent when being wound on the winding disk, so that the windings remain largely stable while falling into the container. For this purpose, the winding materials are essentially metallic wires or strands or cables made thereof.

On the other hand, the windings of the strand shaped winding material can be controlled also at the other axial end of the winding disk and removed again under tension. In this way, the winding device can be used as a storage device for the strand shaped winding material, wherein the windings are "stored temporally" on the winding disk. By varying the degree of the filling of the winding disk, it is possible, for example, to decouple the feeding rate from the stripping rate of the strand shaped winding material, whereby it is possible to balance speed fluctuations or even momentary stoppages within the process of machining of the strand shaped winding material.

For a winding device of the above described type, the following problem arises: Since the winding disk has been revolved continuously by the winding mechanism for the winding material and the windings of the strand shaped winding material are formed on the outer peripheral surface of the winding disk, it is necessary—for a round winding disk—that a volume in the form of a cylinder barrel, e.g., a tubular volume, is set free, wherein the volume has a certain thickness being dependent inter alia on the diameter of the strand shaped winding material, the thickness thereof being radially measured. Since the strand shaped winding material moves in this tubular volume, no other bodies such as a lever or an arrangement of levers may be present there.

However, by the winding of the strand shaped winding material onto the winding disk and/or by the contacting of the strand shaped winding material to the winding disk, forces and/or moments, which have to be supported, are applied to the winding disk. For example, inter alia a torque is applied via the strand shaped winding material to the winding disk, whereas the torque would also rotate the winding disk. In particular, a horizontally arranged winding disk would also be rotated around its vertical axis.

Therefore, for the known winding devices, the winding disk will be mounted, for example, suspending from bearings from above. For this purpose, a vertically arranged rotating hollow shaft through which the strand shaped winding material of the winding device is supplied and from which the winding material is discharged laterally through an opening to be directed to the winding mechanism for the winding material, extends downward to the winding disk, and the winding disk is mounted rotatably suspending on the vertical shaft by a rotary bearing, for example, a roller bearing. By this, the forces in all directions and also the torques around other axes than the vertical axis can be accommodated. However, the torques around the vertical axis and therefore a concomitant rotation of the winding disk cannot be prevented by such a mounting.

For this reason, the known winding devices use, for example, a so-called zero gear or a gear compensation, which generate by their kinematics a counter rotational movement whereby the winding disk is retained in the direction of a rotation around the vertical axis. The zero transmission thus serves to prevent a rotation of the winding disk.

Alternatively, for the known winding devices, the winding disk can also have form fitting elements for accommodating the forces and the torques, for example in the form of a so-called "mechanical sword", e.g., a simple nose-piece on the bottom side of the winding disk which engages in a corresponding groove on the upper side of the container for the strand like winding material. By the thus formed form fitting between the nose-piece and the groove, a concomitant rotation of the winding disk is prevented.

For preventing the rotation of the winding disk (also called "Scholl disk") of a drum winder, the DE 36 42 177 A1 also proposes using permanent magnets consisting of pairs of different poles of plate-shaped segments. In each case, one segment is mounted on a flange of the winding disk and the other segment is mounted on a mounting fixed to the housing. The two segments are arranged so as to be attracted magnetically to each other in the vertical direction. Between the two segments, a disk is running in a small air gap, in which the strand shaped winding material is guided over two deflection rollers to the winding disk and it is wound there.

A magnetic fixation for preventing the rotation of the winding disk is particularly suitable for a non-magnetic strand shaped winding material like, for example, a non-metallic strand shaped winding material or for copper wires or for aluminum wires.

Similarly, for a storage device for a thread shaped material, the DE 23 52 521 A1 proposes preventing the vertically arranged winding disk from rotating by a permanent magnet attached to it and by a permanent magnet fixed to the machine frame. The two block shaped magnets are thereby arranged opposite radially in regard to the winding disk, with a gap between the magnets being formed, through which the thread shaped material can move.

SUMMARY OF CERTAIN INVENTIVE ASPECTS

One inventive aspect relates to a winding device of the described type with an improved means by which the winding disk is prevented from rotating.

One embodiment uses the example of a drum winder with a horizontally arranged winding disk. However, it is not limited to this. The described technology can also be applied to a storage device or to another winding device for a strand shaped winding material.

Another aspect is a winding device for winding a strand shaped winding material with a winding disk onto which the strand shaped winding material is wound, and a housing arranged adjacent to the winding disk, wherein the winding disk is prevented from moving, in particular from rotating, by at least one magnetic holding device, wherein the magnetic holding device comprises a first magnetic arrangement, which is torque proof connected to the housing, and a second magnetic arrangement, which is torque proof connected to the winding disk, each magnetic arrangement having a north pole and a south pole, wherein between the first magnetic arrangement and the second magnetic arrangement a gap is present, wherein the first magnetic arrangement and the second magnetic arrangement are magnetically coupled across the gap, and wherein the strand shaped winding material is guided through the gap.

In some embodiments, the two magnetic arrangements are arranged such so that the south pole of the first magnetic arrangement is opposite to the north pole of the second magnetic arrangement and that the north pole of the first magnetic arrangement is opposite to the south pole of the second magnetic arrangement.

This results into a very high retention force between the two magnetic arrangements and thus between the casing and the winding disk of the winding device, since the proportion of the magnetic flux that passes outside of the first magnetic arrangement and of the second magnetic arrangement extends substantially only into the gap. Thus, a particularly large proportion of the magnetic field, which has been generated by the two magnetic means, can be used for generating the holding force. For example, the outside of the two magnetic means extending field lines of the magnetic field are substantially parallel to each other, so that inversely there are formed nearly no areas of the magnetic field with diverging field lines in which the magnetic field contributes little to generate the holding force.

The magnetic arrangement can include an arrangement of one or more magnetic or magnetizable materials or components, wherein the arrangement—possibly after magnetization—has two magnetic poles of a different polarity, which are also referred to as the north pole and the south pole.

For forming a magnetic holding means, magnetic circuits with hard magnetic portions and/or the soft-magnetic portions can be constructed. The hard magnetic portions and/or soft magnetic portions are disposed within a magnetic holding device, preferably in a parallel circuit and/or in a serial circuit.

The mentioned materials can be soft magnetic materials such as ferromagnetic materials or permanently magnetizable hard magnetic materials. The mentioned components can be permanent magnets. Electromagnets or combinations of permanent magnets and electromagnets can also be used as magnetic sources.

In some embodiments, the first magnetic arrangement and the second magnetic arrangement are coupled in such a way that the field lines, which leave the north pole of the first magnetic arrangement, run through the gap to the south pole of the second magnetic arrangement and enter into the interior of it and are conducted to the north pole of the second magnetic arrangement, leave there, pass through the gap to the south pole of the first magnetic arrangement and enter it and pass inside the first magnetic arrangement to the north pole and merge there.

In some embodiments, the two poles of the first magnetic arrangement are arranged substantially adjacent to each other in the circumferential direction of the winding disk, and also the two poles of the second magnetic arrangement are arranged substantially adjacent to each other in the circumferential direction of the winding disk. The magnetic circuit formed by the magnetic coupling of the first magnetic arrangement and of the second magnetic arrangement then extends substantially in a plane, which contains a tangent of the winding disk or which contains a straight line parallel thereto.

If upon stronger impacting torques the winding disk might rotate slightly, due to the resulting displacement of the above mentioned arrangement of the first magnetic arrangement and second magnetic arrangement, the south pole of the first magnetic arrangement arrives into the vicinity of the south pole of the second magnetic arrangement or the north pole of the first magnetic arrangement arrives into the vicinity of the north pole of the second magnetic arrangement. Thus, in both cases, in addition to the attractive forces between the different poles, repulsive forces appear between the respective same poles that support a backward rotation of the winding disk into the starting position.

In some embodiments, the two poles of the first magnetic arrangement are arranged substantially adjacent to each other in the axial direction of the winding disk, and the two poles of the second magnetic arrangement are arranged substantially adjacent to each other in the axial direction of the winding disk. For the considered horizontally arranged winding disk, the two poles are then arranged each substantially vertically one above the other. Also, the resulting magnetic circuit then extends substantially in a vertical plane.

In some embodiments, a plurality of such magnetic holding devices are arranged in the circumferential direction of the winding disk, the magnetic holding devices having the magnetic arrangements with vertically superposed poles. By this way, the magnetic holding devices consume only little space in the circumferential direction, whereby very many of such holding devices can be arranged along the circumference of the winding disk.

In some embodiments, the polarities of the adjacent circumferential magnetic arrangements are interchanged to each other, e.g., that the north poles and the south poles of the magnetic arrangements are arranged alternating above and below in the circumferential direction. Therefore, a particularly uniform arrangement with continuously alternating polarities is obtained when the number of magnetic holding devices is straight.

In some embodiments, the first magnetic arrangement and the second magnetic arrangement are arranged opposite to each other in the radial direction of the winding disk. This allows that the torques acting around the vertical axis of the winding disk are particularly well accommodated without adverse tilting moments or shear forces acting on the winding disk.

But it is also possible that the first and the second magnetic arrangements are arranged opposite in the axial direction of the winding disk, or in another direction.

In some embodiments, the magnetic circuit, which is coupled by the first magnetic arrangement and by the second magnetic arrangement, extends substantially in a plane parallel to the winding disk.

In some embodiments, the first magnetic arrangement or the second magnetic arrangement is shaped in the form of a horseshoe. This allows the arrangement to be produced in a simple manner, wherein for this arrangement the poles of different polarity of the two magnetic arrangements are facing each other.

Here, the term "horseshoe shaped" can mean that the two poles of different polarities of the magnetic arrangement are substantially pointing in the same direction and that they are continuously connected within the magnetic arrangement by magnetic or magnetizable materials or components.

The term "horseshoe shaped" can be independently of the actual geometric shape of the magnetic arrangement, that means that within that term fall both magnetic arrangements which actually have the shape of a horseshoe and, for example, U-shaped or V-shaped magnetic arrangements, and in particular magnetic arrangements in the form of a rectangle open at one side.

The second magnetic arrangement need not be horseshoe shaped, but can have, for example, the shape of a flat plate or a rod.

However, both the first magnetic arrangement and the second magnetic arrangement can be horseshoe shaped. This allows obtaining the advantages of a horseshoe shaped configuration for the two magnetic arrangements, which again increases the holding power.

In some embodiments, the first magnetic arrangement and/or the second magnetic arrangement comprise at least one permanent magnet. The magnetic arrangements are then completely maintenance free and can, for example by the use of neodymium magnets, generate high holding forces.

In some embodiments, the first magnetic arrangement and/or the second magnetic arrangement comprise at least one electromagnet. As a result, a high magnetic holding force can be generated on the one hand. On the other hand, the magnetic holding forces can also be switched off in a simple manner, for example, when the winding disk has to be replaced. Furthermore, the holding force of the electromagnet can be accurately adjusted by a change of the current flowing through the electromagnet, and thereby, for example, it can be achieved an accurate centering of the winding disk of the winding device and on the container. In some embodiments, only the first magnetic arrangement, which is fixed to the housing, is equipped with an electromagnet, since the power supply is easier to realize on the housing side than on the substantially free standing winding disk.

In some embodiments, the first magnetic arrangement and/or the second magnetic arrangement comprise at least one component of a magnetizable material such as a soft iron or a ferrite. The first magnetic arrangement or the second magnetic arrangement can include a permanent magnet or an electromagnet, and the other magnetic arrangement comprises only one component of a magnetizable material. The first magnetic arrangement and the second magnetic arrangement can be horseshoe shaped in such a way that their poles are formed by the two permanent magnets, which are arranged in parallel and which are magnetized in the opposite direction and which are connected on one side by a soft magnetic closing and guiding element.

In some embodiments, the winding disk is prevented from moving, in particular from rotating, by at least two magnetic holding devices, which are arranged along the circumference of the winding disk. The magnetic holding devices can be arranged at equal intervals along the circumference of the winding disk, to achieve a uniform distribution of the magnetic holding forces acting on the winding disk.

In some embodiments, the at least two magnetic holding devices are arranged opposite to each other with respect to the circumference of the winding disk. All of the magnetic holding devices can be arranged in pairs with respect to the circumference of the winding disk, e.g., the n magnetic holding devices form the corners of a regular polygon with n edges in plane, which is parallel to the cross sectional plane of the winding disk, wherein n is an even number. Hereby, the retaining forces acting on the winding disk are symmetrically distributed around the circumference of the winding disk, so that it is particularly well centered and that the bearing, by which the winding disk is mounted opposite to the winding device, is not affected by high shearing forces.

DETAILED DESCRIPTION OF CERTAIN INVENTIVE EMBODIMENTS

All figures are shown in a plan view from above on a horizontally arranged winding disk 1.

Figure 1:
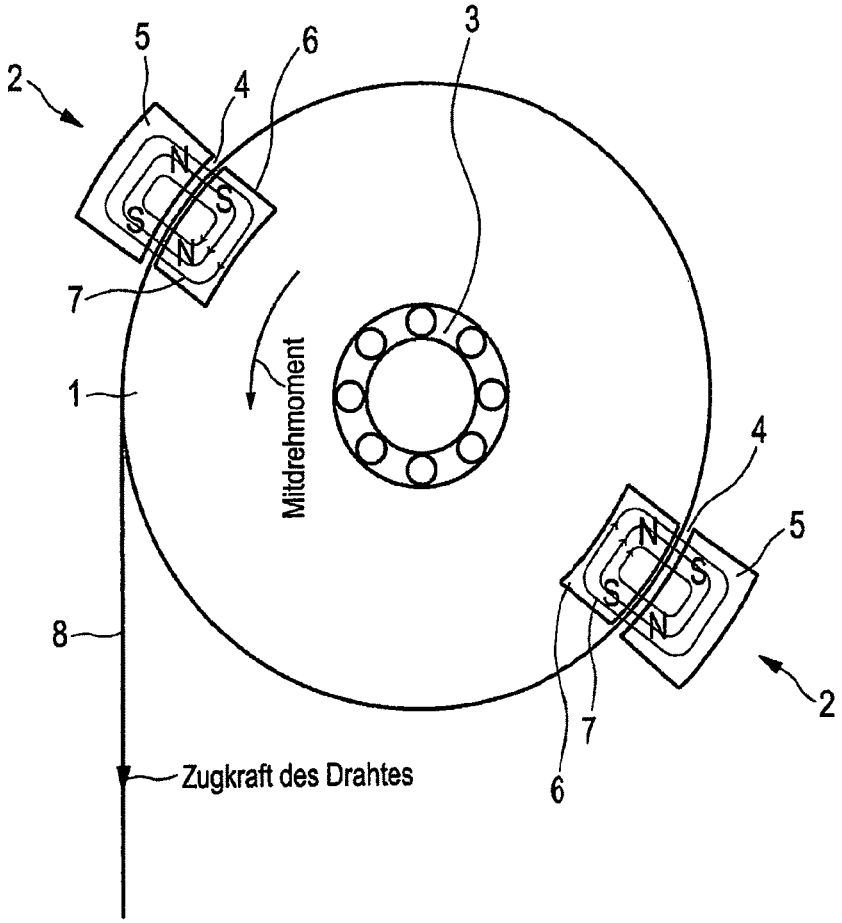
FIG. 1 illustrates a winding disk and two magnetic holding devices of a winding device according to some embodiments including an illustration of the magnetic field lines.

FIG. 1 shows a schematic view of a winding disk 1, and two magnetic holding devices 2 of a winding device according to some embodiments for a wire 8, whereby the two holding devices 2 are arranged diametrically opposite on the outer edge of the winding disk 1 such that each of the first magnetic arrangement 5 and of the second magnetic arrangement 6 are arranged radially opposite. In each case, the south pole of the first magnetic arrangement 5 is arranged opposite to the north pole of the second magnetic arrangement 6, and vice versa. Each of the first magnetic arrangement 5 is fixed to a (not shown) housing of the winding device. Each of the second magnetic arrangement 6 is fixed to the winding disk 1.

The cylindrical winding disk 1 is connected at its central region to the outer side of a pivot bearing 3, for example, a ball bearing, a needle bearing or a roller bearing, wherein the inner side of the pivot bearing 3 is connected via a vertical suspension and, if necessary, via a further pivot bearing to the housing of the winding device. The winding disk 1 is thereby mounted rotatably in regard to the housing. Thus, transverse forces acting on the winding disk 1 are largely absorbed by the pivot bearing 3 and the suspension. However, the concomitant torques around the vertical axis through the center of the winding disk 1 are not absorbed, the concomitant torques being caused by the winding of the winding strand shaped material.

However, the concomitant rotation of the winding disk 1 is prevented by the two symmetrically arranged magnetic holding devices 2. There is an air gap 4 present, through which the wire 8 is passed and wound onto the outer surface of the winding disk 1, between the respective first magnetic arrangement 5 and the respective second magnetic arrangement 6. The closed magnetic field lines 7 within each magnetic holding device 2 are shown schematically.

Figure 2A:
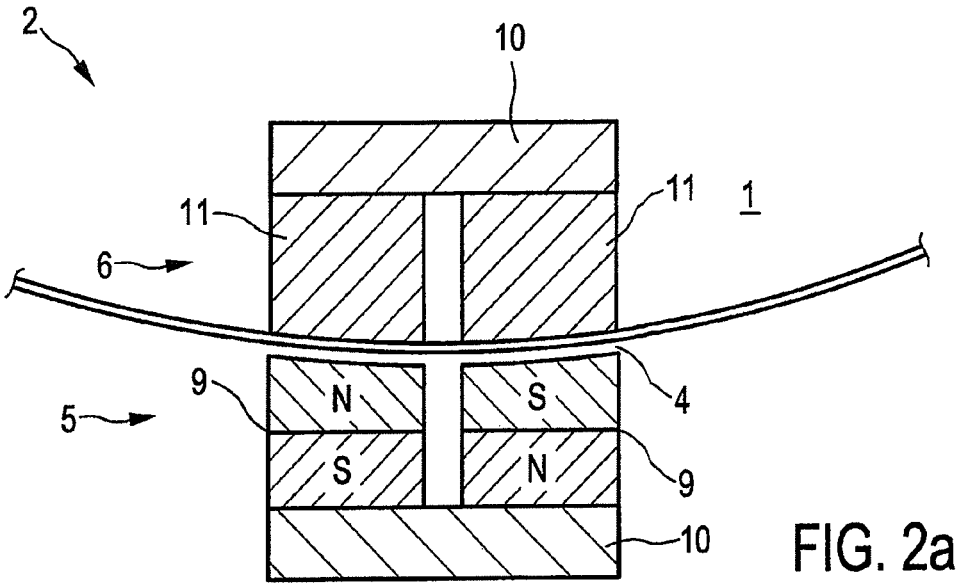
FIGS. 2*a* and 2*b* illustrate detailed illustrations of two magnetic holding devices according to some embodiments with two horseshoe shaped magnetic arrangements.
Figure 2B:
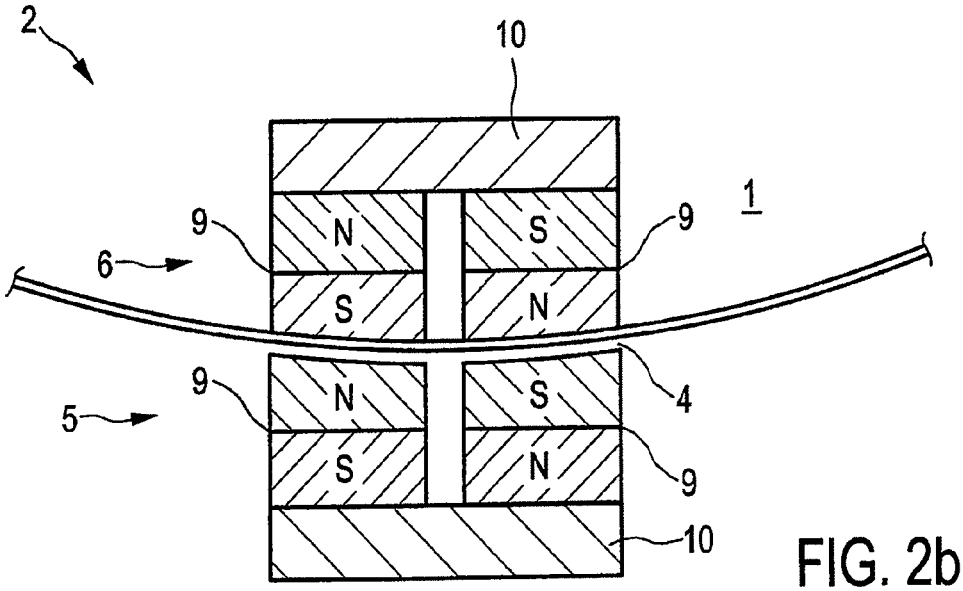

In FIGS. 2*a* and 2*b*, two embodiments of the magnetic holding devices are shown in detail.

In FIG. 2*a*, the first magnetic holding device 5 has arranged at its two poles the permanent magnets 9 each having a north pole N and a south pole S, which are arranged in opposite polarity and in the circumferential direction of the winding disk 1 side by side and parallel to each other. The width of the permanent magnets 9 in the circumferential direction of the winding disk 1 is for the embodiment 120 mm, its height in the axial direction of the winding disk 1 is 30 mm, and the gap between them is 10 mm. At its radially outer ends, the two permanent magnets 9 are connected by a backing plate 10 made of soft iron. Thus, the first magnetic arrangement 5 is formed in a horseshoe shape, so that the magnetic field lines leave the first magnetic arrangement 5 only into the air gap 4. The air gap in the embodiment 4 has a width of between 5 mm and 20 mm, e.g., about 15 mm.

In a mirror image way, directly opposite to the first magnetic arrangement 5, a second magnetic arrangement 6 is arranged on the winding disk 1. The difference to the first magnetic arrangement 5 is that the poles of the second magnetic arrangement 6 are formed not by permanent magnets, but by soft iron blocks 11, which are also connected to a backing plate made 10 of soft iron. Thus, the second magnetic arrangement 6 is formed in the shape of a horseshoe. The entire second magnetic arrangement 6 and the backing plate 10 of the first magnetic arrangement 5 are magnetized by the two permanent magnets 9 of the first magnetic arrangement 5, and a closed magnetic flux through the air gap 4 is formed across the two magnetic arrangements 5 and 6.

The magnetic holding device 2 in FIG. 2*b* differs from that of FIG. 2*a* only in that the poles of the second magnetic arrangement 6 are not formed by soft iron blocks 11, but that they are also formed by the permanent magnet 9, which are arranged such that poles of different polarity of the four involved permanent magnets 9 are arranged opposite at the air gap 4.

Likewise, it is also possible to provide as a component of the second magnetic arrangement 6 an electromagnet. This can easily be made, for example, by wrapping the backing plate 10 with a coil.

An arrangement according to FIG. 2*b* can be chosen, for example, when the lateral holding force, e.g., the tangential holding force in regard to the winding disk 1 of an arrangement according to FIG. 2*a* is not sufficient. This holding force must be such that the concomitant torque caused by the wire 8 and acting on the winding disk 1 is accommodated jointly by all magnetic holding devices 2 taking into account a safety factor. For this embodiment, the achievable holding force of a single magnetic holding device 2 is set, for example, to 100 N.

Figure 3:
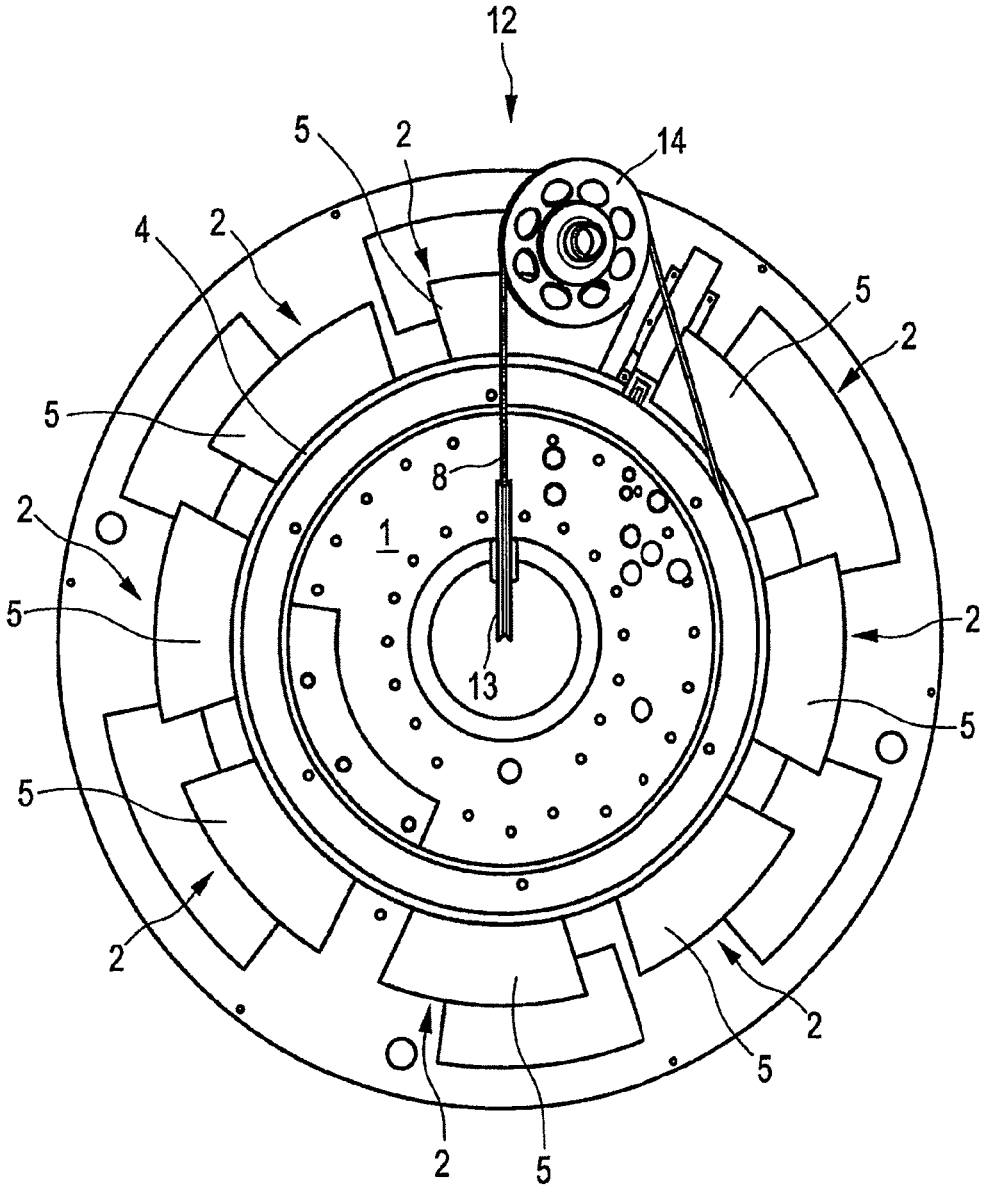
FIG. 3 illustrates a winding device according to some embodiments with eight evenly spaced magnetic holding devices.

FIG. 3 shows a winding disk 1 according to some embodiments with eight magnetic holding devices 2, which are arranged uniformly along the circumference of the winding disk 1. In this case, only the first magnetic arrangements 5 are shown schematically as separate units. The diameter of the winding disk 1 for this embodiment is 650 mm.

Also shown is a winding mechanism 12 for the winding material having a first deflection roller 13, which deflects the wire 8, which has been supplied perpendicular from the above winding disk 1, into the horizontal direction, and a second deflection roller 14 which is slightly tilted in regard to the horizontal direction and which deflects the wire 8 in a slight angle down into a direction which is nearly tangential to the winding disk 1. The first deflecting roller 13 and the second deflecting roller 14 are rigidly connected together and driven on a (not shown) rotor over the or around the winding disk 1, in the embodiment of FIG. 3 in the counterclockwise direction. Thereby, the wire 8 is applied to the outer surface of the winding disk 1 in the air gap 4 between the first magnetic arrangements 5 and the second magnetic arrangements 6 tangentially, in order to form the desired windings.

Due to the large number of eight magnetic holding devices 2, the winding disk 1 can be held sufficiently, so as to be prevented from rotating by the torque exerted on the winding disk 1 by the tensioned wire 8. At the same time, it is formed a circumferential pre-stressing of the magnets to each another.

Figure 4:
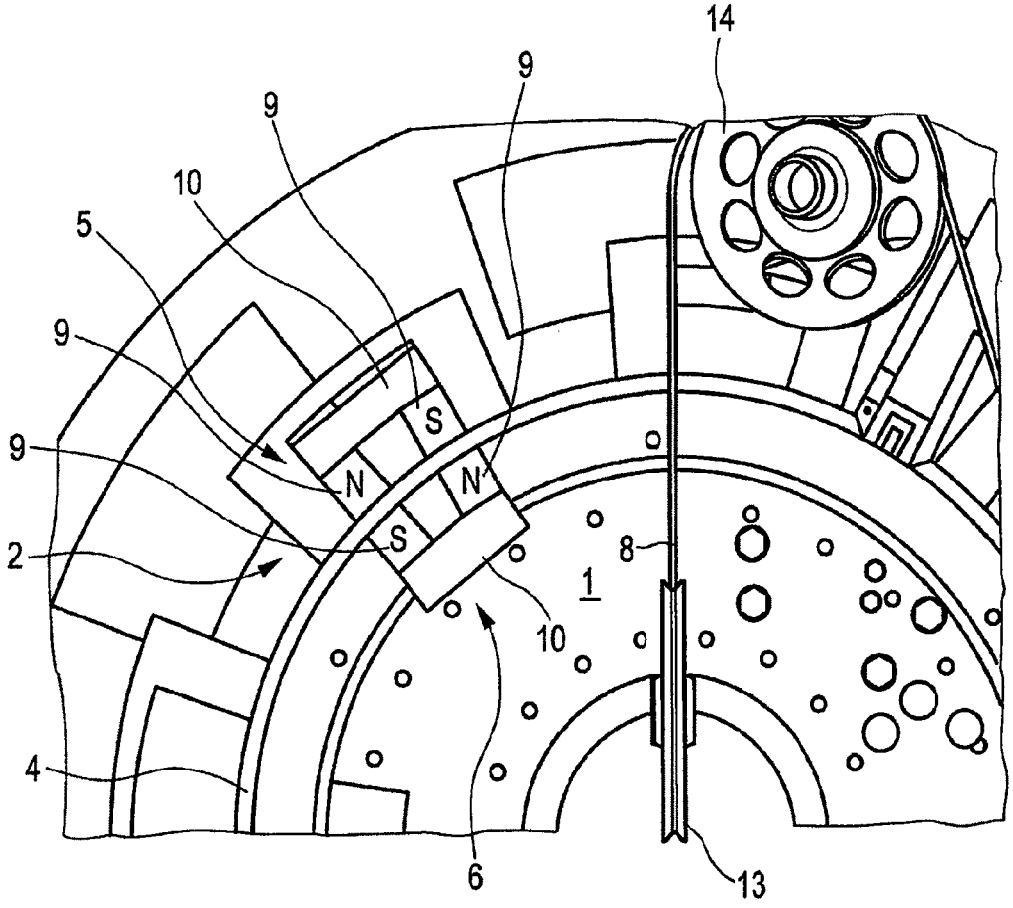
FIG. 4 illustrates a magnetic anchoring device of FIG. 3 in a detailed view.

FIG. 4 shows a detail from FIG. 3, wherein one of the eight magnetic holding devices 2 is shown, comprising two horseshoe shaped magnetic arrangements 5 and 6 as shown in FIG. 2*b*.

Figure 5A:
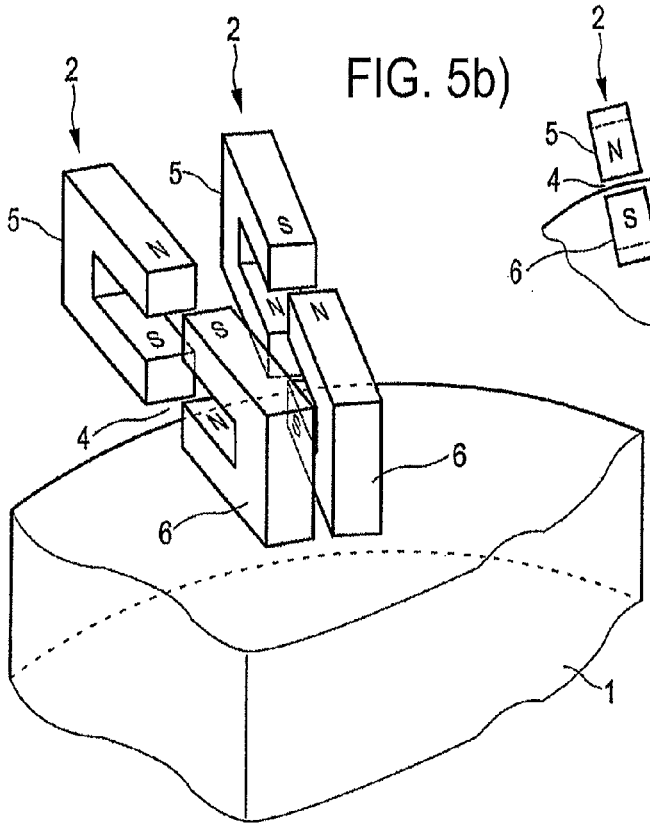
FIG. 5*a* is a perspective view of an embodiment with two magnetic holding devices.
Figure 5B:
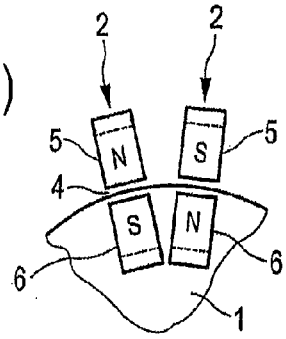
FIG. 5*b* is a top view of the embodiment shown in FIG. 5*a*.

FIGS. 5*a* and 5*b* show schematically an embodiment with the two magnetic holding devices 2, wherein FIG. 5*b* shows a top view of the perspective view shown in FIG. 5*a*.

Figure 5C:
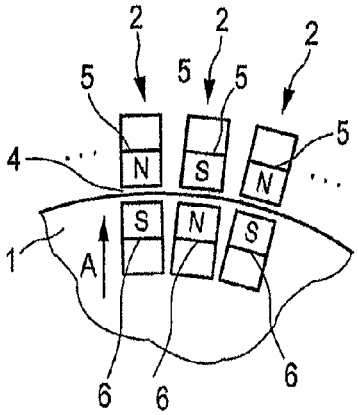
FIG. 5*c* is a top view of an embodiment with three magnetic holding devices.
Figure 5D:
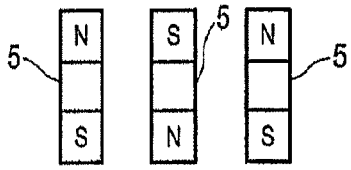
FIG. 5*d* is a view of the FIG. 5*c* embodiment seen in the direction of the arrow A shown in FIG. 5*c*.

FIGS. 5*c* and 5*d* show schematically an embodiment with the three magnetic holding devices 2, wherein FIG. 5*d* shows a view in the direction which has been indicated by the arrow A shown in the top view of FIG. 5*c*.

For both embodiments, the poles of the first and second horseshoe shaped magnetic arrangements 5, 6 are respectively arranged vertically above one another. The first and second magnetic arrangements 5, 6 are also arranged radially opposite to each other.

For the three magnetic holding devices 2, which are shown in FIGS. 5*c* and 5*d*, the north poles N and the south poles S of the first and of the second magnetic arrangements 5, 6 point alternately upwards and downwards in the circumferential direction of the winding disk 1.

While the inventive technology has been described with reference to the figures, it will be understood by those of ordinary skill in the art that various changes in form and details may be made therein without departing from the spirit and scope as defined by the following claims.

What is claimed is:

1. A winding device for winding a strand shaped winding material, the device comprising:

a winding disk onto which the strand shaped winding material is wound; and a housing being arranged adjacent to the winding disk, wherein the winding disk is prevented from moving and rotating, by at least one magnetic holding device, wherein the magnetic holding device comprises a first magnetic arrangement, which is torque proof connected with the housing and which has a north pole (N) and a south pole (S) and a second magnetic arrangement, which is torque proof connected with the winding disk and which is configured to have a north pole (N) and a south pole (S), wherein a gap is formed between the first magnetic arrangement and the second magnetic arrangement, wherein the first and second magnetic arrangements are magnetically coupled through the gap, wherein the strand shaped winding material is configured to pass through the gap, and wherein the first and second magnetic arrangements are arranged so that the south pole (S) of the first magnetic arrangement is arranged opposite to the north pole (N) of the second magnetic arrangement, wherein the north pole (N) of the first magnetic arrangement is arranged opposite to the south pole (S) of the second magnetic arrangement, and wherein the first or the second magnetic arrangement has at least two hard magnetic sections which are arranged in series.

2. The winding device according to claim 1, wherein each of the at least two hard magnetic sections includes south and north poles, wherein the two poles of the first magnetic arrangement are arranged substantially adjacent to each other in the circumferential direction of the winding disk and wherein the two poles of the second magnetic arrangement are arranged substantially adjacent to each other in the circumferential direction of the winding disk.

3. The winding device according claim 1, wherein the first and second magnetic arrangements are arranged opposite to each other in the radial direction of the winding disk.

4. The winding device according to claim 1, wherein the first magnetic arrangement or the second magnetic arrangement is formed in the shape of a horseshoe.

5. The winding device according to claim 4, wherein the first and second magnetic arrangements are formed in the shape of a horseshoe.

6. The winding device according to claim 1, wherein the first magnetic arrangement and/or the second magnetic arrangement comprises at least one permanent magnet.

7. The winding device according to claim 1, wherein the at least one magnetic holding device comprises at least two magnetic holding devices, wherein the winding disk is prevented from twisting, by the at least two magnetic holding devices, which are arranged along a circumference of the winding disk.

8. The winding device according to claim 7, wherein the at least two magnetic holding devices are arranged opposite to each other in respect to the circumference of the winding disk.

9. The winding device according claim 1, wherein the at least two hard magnetic sections comprise first and second hard magnetic sections each including south and north poles, wherein the north and south poles of the first hard magnetic section respectively face the north and south poles of the first hard magnetic section in the circumferential direction of the winding disk.

10. The winding device according claim 1, wherein each of the at least two hard magnetic sections comprises south and north poles arranged in the radial direction of the winding disk.

11. A winding device for winding a strand shaped winding material, the device comprising:

a winding disk onto which the strand shaped winding material is wound; and a housing being arranged adjacent to the winding disk, wherein the winding disk is prevented from moving and rotating, by at least one magnetic holding device, wherein the magnetic holding device comprises a first magnetic arrangement, which is torque proof connected with the housing and which has a north pole (N) and a south pole (S) and a second magnetic arrangement, which is torque proof connected with the winding disk and which is configured to have a north pole (N) and a south pole (S), wherein a gap is formed between the first magnetic arrangement and the second magnetic arrangement, wherein the first and second magnetic arrangements are magnetically coupled through the gap, wherein the strand shaped winding material is configured to pass through the gap, and wherein the first and second magnetic arrangements are arranged so that the south pole (S) of the first magnetic arrangement is arranged opposite to the north pole (N) of the second magnetic arrangement, wherein the north pole (N) of the first magnetic arrangement is arranged opposite to the south pole (S) of the second magnetic arrangement, and wherein the first or the second magnetic arrangement has at least one hard magnetic section, which is arranged essentially in the radial direction of the winding disk.

12. A winding device for winding a strand shaped winding material, the device comprising:

a winding disk onto which the strand shaped winding material is wound; and a housing being arranged adjacent to the winding disk, wherein the winding disk is prevented from moving and rotating, by at least two magnetic holding devices, wherein each of the two magnetic holding devices comprises a first magnetic arrangement, which is torque proof connected with the housing and which has a north pole (N) and a south pole (S) and a second magnetic arrangement, which is torque proof connected with the winding disk and which is configured to have a north pole (N) and a south pole (S), wherein a gap is formed between the first magnetic arrangement and the second magnetic arrangement, wherein the first and second magnetic arrangements are magnetically coupled through the gap, wherein the strand shaped winding material is configured to pass through the gap, and wherein the first and second magnetic arrangements are arranged so that the south pole (S) of the first magnetic arrangement is arranged opposite to the north pole (N) of the second magnetic arrangement, wherein the north pole (N) of the first magnetic arrangement is arranged opposite to the south pole (S) of the second magnetic arrangement, and wherein a circumferential pre-stressing of the at least two magnetic holding devices to each other is formed.

* * * * *